US009994978B2

(12) United States Patent
Truesdale

(10) Patent No.: US 9,994,978 B2
(45) Date of Patent: Jun. 12, 2018

(54) FLAME RESISTANT FABRICS HAVING IMPROVED RESISTANCE TO SURFACE ABRASION OR PILLING AND METHODS FOR MAKING THEM

(75) Inventor: Rembert Joseph Truesdale, Thomaston, GA (US)

(73) Assignee: Southern Mills, Inc., Union City, GA (US)

( * ) Notice: Subject to any disclaimer, the term of this patent is extended or adjusted under 35 U.S.C. 154(b) by 703 days.

(21) Appl. No.: 12/348,789

(22) Filed: Jan. 5, 2009

(65) Prior Publication Data

US 2009/0178186 A1 Jul. 16, 2009

Related U.S. Application Data

(60) Provisional application No. 61/019,002, filed on Jan. 4, 2008, provisional application No. 61/107,582, filed on Oct. 22, 2008.

(51) Int. Cl.
*D03D 15/12* (2006.01)
*D06M 13/325* (2006.01)
(Continued)

(52) U.S. Cl.
CPC ..... *D03D 15/12* (2013.01); *D06M 13/325* (2013.01); *D06M 13/419* (2013.01); *D06M 15/227* (2013.01); *D06M 15/277* (2013.01); *D06M 15/423* (2013.01); *D06M 15/576* (2013.01); *A41D 31/0022* (2013.01); *D06M 2200/35* (2013.01); *Y10T 442/273* (2015.04);
(Continued)

(58) Field of Classification Search
USPC ..... 442/301, 304, 148; 428/920, 921
See application file for complete search history.

(56) References Cited

U.S. PATENT DOCUMENTS 3,527,557 A 9/1970 Cheape et al.
4,145,547 A * 3/1979 Weil ..... 548/112
(Continued)

FOREIGN PATENT DOCUMENTS

EP 0412195 A 2/1991
JP 03-249280 11/1991
(Continued)

OTHER PUBLICATIONS

PCT International Search Report and Written Opinion, dated Dec. 1, 2009, PCT/US2009/030111.
(Continued)

*Primary Examiner* — Marla D McConnell
*Assistant Examiner* — Kevin Worrell
(74) *Attorney, Agent, or Firm* — Kilpatrick Townsend & Stockton LLP

(57) ABSTRACT

Flame resistant fabrics and garments that have improved resistance to pilling and/or abrasion are disclosed. The fabrics, the fibers or yarns that make up the fabrics, or garments made from the fabrics are treated with a finish composition that is applied to the fibers, yarns, fabrics, or garments and then cured. The finish composition increases the resistance to pilling and/or abrasion of the fibers, yarns, fabrics, or garments. The finish composition includes a polymeric abrasion resistance aid, an alkylfluoropolymer, a polyethylene, and a wetting agent.

33 Claims, 9 Drawing Sheets
(8 of 9 Drawing Sheet(s) Filed in Color)

(51) Int. Cl.

| | |
|---|---|
| ***D06M 13/419*** | (2006.01) |
| ***D06M 15/227*** | (2006.01) |
| ***D06M 15/277*** | (2006.01) |
| ***D06M 15/423*** | (2006.01) |
| ***D06M 15/576*** | (2006.01) |
| *A41D 31/00* | (2006.01) |

(52) U.S. Cl.
CPC .... *Y10T 442/2713* (2015.04); *Y10T 442/3976* (2015.04); *Y10T 442/40* (2015.04)

(56) References Cited

U.S. PATENT DOCUMENTS

| | | | | |
|---|---|---|---|---|
| 4,240,795 | A | 12/1980 | Hendrix | |
| 4,304,811 | A | 12/1981 | David et al. | |
| 4,670,327 | A | 6/1987 | Weber | |
| 4,750,443 | A | 6/1988 | Blaustein et al. | |
| 4,843,646 | A | 7/1989 | Grilliot et al. | |
| 4,920,000 | A | 4/1990 | Green | |
| 5,098,770 | A | 3/1992 | Paire | |
| 5,246,782 | A | 9/1993 | Kennedy et al. | |
| 5,399,418 | A | 3/1995 | Hartmanns et al. | |
| 6,192,520 | B1 | 2/2001 | Underwood et al. | |
| 6,387,999 | B1 * | 5/2002 | Dirschl et al. | 524/537 |
| 6,430,754 | B1 | 8/2002 | Taylor et al. | |
| 6,591,427 | B1 | 7/2003 | Bennett | |
| 6,624,096 | B2 | 9/2003 | Thomas et al. | |
| 6,668,868 | B2 | 12/2003 | Howland et al. | |
| 6,693,052 | B2 | 2/2004 | Howland | |
| 6,840,288 | B2 | 1/2005 | Zhu et al. | |
| 7,013,495 | B2 | 3/2006 | Dunn | |
| 7,065,950 | B2 | 6/2006 | Zhu et al. | |
| 2002/0106955 | A1 | 8/2002 | Underwood et al. | |
| 2003/0008990 | A1 * | 1/2003 | McCarthy | 526/247 |
| 2003/0092598 | A1 | 5/2003 | Gardner et al. | |
| 2003/0203690 | A1 | 10/2003 | Hess et al. | |
| 2003/0226612 | A1 | 12/2003 | Zhu et al. | |
| 2003/0228812 | A1 * | 12/2003 | Stanhope et al. | 442/49 |
| 2003/0228821 | A1 | 12/2003 | Zhu et al. | |
| 2003/0232560 | A1 | 12/2003 | Corner | |
| 2005/0025962 | A1 | 2/2005 | Zhu et al. | |
| 2005/0050619 | A1 | 3/2005 | Dunn | |
| 2005/0085145 | A1 * | 4/2005 | Fang et al. | 442/95 |
| 2005/0106967 | A1 | 5/2005 | Suzuki | |
| 2005/0165154 | A1 * | 7/2005 | Kosuge et al. | 524/494 |
| 2005/0204487 | A1 | 9/2005 | Zhu | |
| 2006/0046034 | A1 * | 3/2006 | Schober | 428/195.1 |
| 2006/0084337 | A1 * | 4/2006 | Corner et al. | 442/203 |
| 2006/0143809 | A1 | 7/2006 | Dunn | |
| 2007/0184737 | A1 * | 8/2007 | Corner et al. | 442/203 |

FOREIGN PATENT DOCUMENTS

| | | | |
|---|---|---|---|
| JP | 2557995 | | 9/1996 |
| JP | 09-111661 | | 4/1997 |
| JP | 2001-519843 | A | 10/2001 |
| JP | 2007-529648 | | 10/2007 |
| WO | 02/052077 | A | 7/2002 |
| WO | 2003/016604 | | 2/2003 |
| WO | 2004/088023 | | 10/2004 |
| WO | 05/090661 | A | 9/2005 |
| WO | 2006/043958 | | 4/2006 |
| WO | 2007/070079 | | 6/2007 |

OTHER PUBLICATIONS

Communication Relating to the Results of the Partial International Search from PCT/US2009/030111, dated Apr. 23, 2009.

PCT Partial International Search Report, dated Apr. 23, 2009, PCT/US2009/030111.

Borghetty, "Cotton Crushproofing—Theory, Chemistry, Application", Textile World, Dec. 1955, pp. 102-117.

Dyeing and Finishing Normex® Type 450 Aramid, DuPont Technical Information, Bulletin NX-9, Mar. 1978, pp. 1-7.

Joyner, "Aminofunctional Polysiloxanes: A New Class of Softeners", Textile Chemist and Colorist, Mar. 1986, vol. 18, No. 3, pp. 34-37.

Office Action, Japanese Patent Application No. JP 2010-541579, dated Jan. 22, 2013.

Office Action, Japanese Patent Application No. JP 2010-541579, dated Jan. 7, 2014.

Examiner's Report, Australian Patent Application No. 2009204381, dated Mar. 14, 2014.

Office Action, European Patent Application No. 09701113.4, dated Jun. 26, 2014.

Office Action, Canadian Patent Application No. 2,708,960, dated Aug. 26, 2014.

Examiner's Report, Australian Patent Application No. 2009204381, dated Mar. 25, 2015.

Office Action, Canadian Patent Application No. 2,708,960, dated May 12, 2015.

Office Action, Japanese Patent Application No. 2015-043158, dated Jun. 28, 2016.

Office Action, Japanese Patent Application No. 2015-043158, dated May 23, 2017.

Examination Report, Australian Patent Application No. 2016201480, dated Aug. 22, 2017, 4 pages.

* cited by examiner

FLAME RESISTANT FABRICS HAVING IMPROVED RESISTANCE TO SURFACE ABRASION OR PILLING AND METHODS FOR MAKING THEM

CROSS REFERENCE TO RELATED APPLICATIONS

This application claims the benefit of U.S. Provisional Application No. 61/019,002, filed Jan. 4, 2008 and U.S. Provisional Application No. 61/107,582, filed Oct. 22, 2008.

FIELD OF THE INVENTION

The present invention relates to flame resistant fabrics that are resistant to surface abrasion and/or pilling, to novel finish compositions for fabrics that impart abrasion and/or pilling resistance, and to methods for imparting abrasion and/or pilling resistance.

BACKGROUND

Many occupations including, but not limited to, firefighting, emergency response, search and rescue, and military service, may require exposure to extreme heat and/or flames. To avoid being injured while working in such conditions, individuals typically wear protective garments constructed of special flame resistant materials designed to protect them from both heat and flames. These protective garments include, for example, garments worn by firefighters, which are commonly referred to in the industry as turnout gear. Turnout gear can include various garments including coveralls, trousers, and jackets. These garments typically include several layers of material such as an outer shell that protects the wearer from flames, a moisture barrier that prevents the ingress of water into the garment, and a thermal barrier that insulates the wearer from extreme heat. Other types of protective garments are worn by individuals such as petrochemical workers, electrical workers, those engaged in military service, and others who require protection from extreme heat and/or flames.

Some individuals including, but not limited to, emergency personnel such as firefighters and other first responders, are not only exposed to extreme heat or flames, but are also exposed to water. In those instances it would be desirable for a flame resistant fabric to also have water repellant properties. Thus, turnout gear and other protective garments may include woven fabrics formed of one or more types of flame resistant fibers, and the fabrics may also have water repellant properties.

Protective garments must withstand flame, excessive heat, and abrasion, and in many instances they are constructed of a flame resistant material that is both strong and durable. These protective fabrics are expensive, so durability of the fabrics is important. Abrasion refers to the wearing away of any part of a material by rubbing against another surface. While flame resistant fibers will retain their flame resistance even if the fabric becomes abraded, a protective fabric that becomes abraded may lose other protective properties such as water repellency. An abraded garment may not provide the protection needed by a firefighter, emergency responder, or other individual. Therefore, if a protective garment becomes abraded, that garment must be replaced. Garments having increased abrasion resistance would need to be replaced less frequently than conventional protective garments. A fabric's resistance to abrasion can be measured by various test methodologies and equipment such as the test procedures described by ASTM standards D3886 and D3884.

Many protective fabrics, including those using ring spun yarns, filament yarns, or combinations thereof can have a tendency to pill. "Pills" are relatively small balls of entangled fibers that can form on the surface of a protective fabric. The pills are held to the surface of the protective fabric by one or more fibers comprising the fabric. While most fabrics pill, the protective fabrics of the present invention are made of strong fibers which hold onto the pills more tightly than many other fibers. Thus, pills that form on these protective fabrics tend to build up on the fabrics. Such pills can accumulate over time or otherwise increase in number on the surface of the fabric causing an otherwise smooth surface to appear worn or in extreme cases unsightly. In some instances, the unsightly appearance of a protective fabric may cause the associated garment to be considered inferior in quality and may discourage a user from using the garment. In many instances, the garment may be replaced prematurely even though the fabric of the garment can still provide suitable protection for the user. A fabric's resistance to pilling can be measured by various test methodologies and equipment, such as a random tumble pilling tester and the test procedures described by ASTM standard D3512.

Conventional techniques to reduce the tendency of fabrics to pill use particular yarns with mechanical twisting of the yarns, such as air jet spun yarns. However, some fibers, including some fibers used in the fabrics of the present invention, cannot be spun by air jets. Furthermore, protective garments made from air jet spun yarns can still be prone to pilling since entangled fibers remain and can form pills on the surface of such fabrics.

It is known in the art to treat fabrics with finishes where the finishes impart a particularly useful property to the fabric. For example, some prior art finishes are water repellant finishes that include an alkylfluoropolymer and other optional additives such as a blocked isocyanate crosslinker, paraffinic waxes, and the like. Other prior art finishes include a moisture management finish which includes softeners, permanent press resins and hydrophilic polymers to impart fabric and fiber hydrophilicity. In either case, fabrics exposed to rigorous physical abrasion tend to show yarn breakage, formation of pills, or both depending on the exact construction and fiber blend used in the fabric.

Prior art finish compositions may also provide some resistance to abrasion and/or pilling. As an example, a composition including a wetting agent, one or more fluoropolymers, a wax fluorochemical extender/water repellant, a melamine formaldehyde resin, and a crosslinking agent has been used. This finish composition was developed and applied to fabrics to impart water repellency that was more durable than the water repellency imparted by previously known formulations. This finish imparts some resistance to abrasion compared to untreated fabrics, but fabrics treated with this finish are still fairly easily abraded. For example, these fabrics only withstand about 500 Taber abrasion cycles before a first thread break when tested in accordance with ASTM D3884, using H-18 wheels and a 500 g load on each wheel.

There remains a need for fabrics and protective garments with improved resistance to surface abrasion and/or pilling.

Accordingly, it is desirable to provide a finish composition capable of imparting such improved resistance to abrasion and/or pilling to a variety of fabrics. It is further desirable to provide flame resistant fabrics and protective garments with improved surface abrasion and/or pilling resistance. Finally, it is desirable to provide flame resistant and water repellant fabrics and protective garments with improved surface abrasion and/or pilling resistance.

SUMMARY OF THE INVENTION

The above mentioned objectives are accomplished by embodiments of the present invention.

One embodiment of the present invention is a fabric that has improved resistance to surface abrasion and/or pilling over prior art fabrics. One preferred embodiment of the present invention is a protective fabric that includes a composition of flame resistant fibers, wherein the fibers or the fabric has been treated with a novel finish composition, and wherein the protective fabric has improved resistance to surface abrasion and/or pilling over untreated protective fabrics and over fabrics treated with prior art finish compositions.

Another embodiment of the invention is a protective garment made from a fabric that includes a composition of flame resistant fibers, wherein the protective garment has improved resistance to pilling and/or surface abrasion over prior art protective garments.

Further embodiments of the invention are protective fabrics and garments with improved resistance to surface abrasion and/or pilling wherein the fabrics and garments include a composition of flame resistant fibers and wherein the fabrics and garments further have water repellant properties.

Another embodiment of the present invention is a novel finish composition that may be applied to fibers, fabrics, or garments and that imparts abrasion and/or pilling resistance to those fibers, fabrics, and garments. In one embodiment, the fibers, fabrics, or garments are flame resistant. In one embodiment the novel finish composition comprises at least a polymeric abrasion resistance aid, an alkylfluoropolymer, a polyethylene, and a wetting agent. This composition improves upon prior art compositions by improving the abrasion and/or pilling resistance of fabrics treated with the composition. Tests show that fabrics treated with finish compositions according to the present invention show improved resistance to abrasion and/or pilling compared to untreated fabrics or fabrics treated with prior art finish compositions.

Still other embodiments of the invention are methods for imparting improved resistance to surface abrasion and/or pilling to fabrics or garments. These methods include the steps of applying the novel finish composition to a fiber, a yarn, a fabric comprising a plurality of fibers or yarns, or a garment and curing the finish composition. The methods provide fabrics and garments that have improved resistance to abrasion and pilling over fabrics and garments that have not been treated according to these methods.

Other systems, methods, processes, devices, features, and advantages associated with the fabrics and garments described herein will be or will become apparent to one with skill in the art upon examination of the following drawings and detailed description. All such additional systems, methods, processes, devices, features, and advantages are intended to be included within this description, and are intended to be included within the scope of the present invention.

BRIEF DESCRIPTION OF THE DRAWINGS

The patent or application file contains at least one drawing executed in color. Copies of this patent or patent application publication with color drawings will be provided by the Office upon request and payment of the necessary fee.

The present invention can be better understood with reference to the following drawings. The components in the drawings are not necessarily to scale.

DETAILED DESCRIPTION OF THE INVENTION

Figure 1:
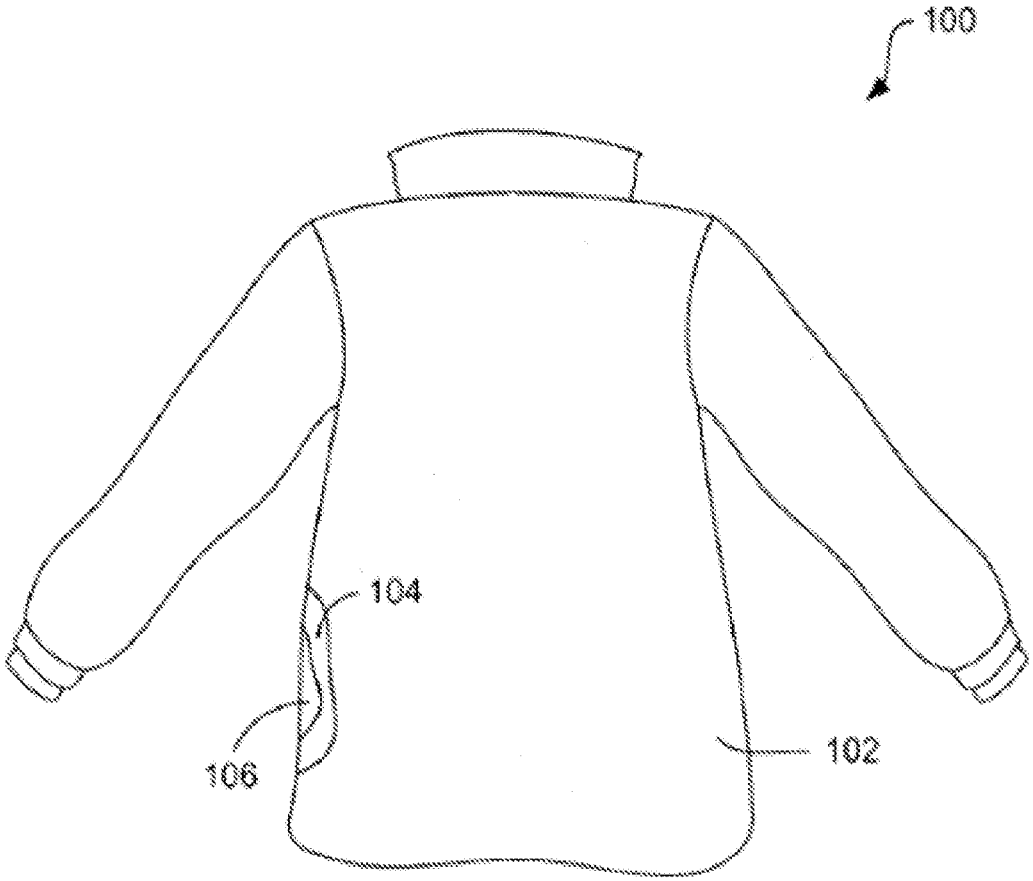
Fig. 1 (Prior Art)
FIG. 1 illustrates a partial cut-away view of a protective garment.

One embodiment of the present invention provides fabrics that are resistant to abrasion and/or pilling. Abrasion tests were conducted on these fabrics and prior art fabrics, and the fabrics consistent with the present invention had an abrasion resistance at least twice that of fabrics treated with prior art formulations. For example, the fabrics of the present invention withstand at least 1000 cycles before the first thread break according to ASTM D3884 Standard Test Method for Abrasion Resistance of Textile Fabrics (Rotary Platform, Double-Head Method), using H-18 wheels and a 500 g load on each wheel. The abrasion resistance of the fabrics more preferably is 1500 cycles before the first break, and most preferably is 2500 cycles before the first break. Additionally or alternatively, these fabrics have a pilling performance rating of at least 4 after 60 minutes and a rating of at least 3 after 90 minutes according to ASTM D3512 Standard Test Method for Pilling Resistance and Other Related Surface Changes of Textile Fabrics Random Tumble Pilling Tester. More preferably the fabrics have a rating of at least 4 after 90 minutes and a rating of at least 3 after 120 minutes.

In one embodiment, the fabric is a flame resistant fabric. The fabric preferably has flame resistant properties which remain after the finish composition is applied. The fabric may further have water repellant properties which also remain after the finish composition is applied. The fabric is intended to meet all flame resistance, thermal resistance, and water repellency requirements of one or more of the following: NFPA 1951, NFPA 1971, NFPA 1977, NFPA 2112, NFPA 70E, and military specifications MIL-C-83429B and GL-PD-07-12. For example, according to NFPA 1971 an outer shell fabric for firefighters must exhibit a char length of less than or equal to 4.0 inches after flame exposure and the fabric must exhibit an afterflame of less than 2.0 seconds when tested in accordance with ASTM D6413.

Flammability of the fabrics of the present invention was tested according to ASTM D6413 Standard Test Method for Flame Resistance of Textiles (Vertical Test). The fabrics exhibited a char length of no more than 0.8 inches in the warp direction and 0.6 inches in the fill direction before laundering and a char length of no more than 0.6 inches in the warp direction and 0.5 inches in the fill direction after five launderings. The fabrics exhibited an afterflame of 0.0 seconds both before laundering and after five launderings. The water repellant properties of the fabrics were determined in accordance with AATCC Test Method 22 Water Repellency: Spray Test and NFPA 1971, 8.26 Water Absorption Resistance Test. The fabrics have a water spray rating of 100 before laundering and a water spray rating of at least 70 after five launderings. The fabrics exhibited a water absorption of no more than 1.0% before laundering and no more than 2.0% after five launderings.

The flame resistant fabric may be a fabric that has been treated with a finish composition according to an embodiment of the present invention. Suitable flame resistant fabrics include, but are not limited to, fabrics comprising inherently flame resistant fibers such as aramid (meta-aramid or para-aramid), polybenzimidazole (PBI), polybenzoxazole (PBO), melamine, polyimide, polyimideamide, modacrylic fibers, FR rayon and combinations thereof. Specific commercially available fibers suitable for use with the present invention either alone or in combination with other fibers include KEVLAR® (a para-aramid), NOMEX® (a meta-aramid), TWARON® (a para-aramid), TECHNORA® (an aromatic co-polyamide), and ZYLON® (a polybenzoxazole). Other suitable fabrics include fabrics comprising non-inherently flame resistant fibers that have been rendered flame resistant by treating such fibers with a suitable flame retardant. Such fibers include, but are not limited to, nylon, cellulosic fibers such as rayon, cotton, acetate, triacetate, lyocell, and combinations thereof. A suitable fabric may be a plain weave fabric or a fabric having another configuration such as, but not limited to, rip-stop, twill weave, sateen weave, or knitted and these configurations may be stretch or non-stretch. The flame resistant fabric may additionally have water-resistant properties and/or may be treated with a water-resistant finish to prevent or reduce water absorption from the outside environment in which a garment constructed from the fabric may be used.

Another embodiment of the present invention is a garment made from a fabric that has been treated with a finish composition wherein the finish composition improves the resistance of the fabric, and therefore the resistance of the garment, to pilling and/or surface abrasion. The garment preferably has flame resistant properties which remain after the finish composition is applied. The garment may further have water repellant properties which also remain after the finish composition is applied.

Preferably, the majority of the fibers of the outer surface of the protective garment of the present invention are constructed of a flame resistant material such as meta-aramid, para-aramid, flame resistant cellulosic materials (e.g. flame resistant cotton, rayon, or acetate), polybenzoxazole (PBO), or polybenzimidazole (PBI).

FIG. 1 illustrates an example of a protective garment 100 for which the fabric of this invention is particularly well-suited. The garment 100 can be a firefighter turnout coat (shown in FIG. 1) or any other garment or garment layer that is flame resistant and surface abrasion and/or pilling resistant as described herein. Although a turnout coat is used as an example and explicitly discussed herein, a coat has been identified for purposes of example only. Accordingly, the present invention is not limited to firefighter turnout coats but instead pertains to substantially any garments that may be worn by a firefighter, rescue worker, military, electrical worker, petrochemical worker, or other individual to provide thermal or another type of protection. Such garments include but are not limited to shirts, pants, jackets, coveralls, vests, t-shirts, underwear, gloves, liners for gloves, hats, helmets, boots, and the like. The present invention is not limited to garments, but can include other uses for flame resistant, and pilling and/or surface abrasion resistant fabrics irrespective of their application.

The garment 100 shown in FIG. 1 includes an outer shell 102 that forms an exterior surface of the garment 100, a barrier layer 104 that forms an intermediate layer of the garment, and a thermal liner 106 that forms an interior surface of the garment 100. For general reference, the exterior surface or outer shell 102 can be directly exposed to the environment in which the user or wearer is operating, and the interior surface of the thermal liner 106 is a surface that contacts the user or wearer, or contacts the clothes the user or wearer may be wearing. In accordance with an embodiment of the invention, some or all of the layers 102, 104, or 106 forming garment 100 can include the flame resistant, pilling and/or surface abrasion resistant fabrics of this invention.

Another embodiment of the present invention is a fabric finish composition capable of imparting abrasion and/or pilling resistance to fibers, fabrics, and garments. According to various embodiments of the invention, a finish is capable of improving the resistance of the fibers, fabrics, or garments to surface abrasion and/or pilling. Preferably, the finish is capable of improving the surface abrasion and pilling resistance of a flame resistant and/or water resistant fabric without reducing the flame retardant or water resistant properties of the fabric. The application of the finish to the fabric can vary depending upon the desired physical properties of the treated fabric, the composition of the fabric, and the types of fibers or body yarns selected for the fabric.

In some embodiments the finish composition of the present invention can improve the after-wash appearance of certain fabrics containing para-aramids by reducing the amount of fibrillation that occurs during washing According to one embodiment of the invention, a suitable finish can be a combination of a polymeric cross-linking abrasion resistance aid, an alkylfluoropolymer, a polyethylene, and a wetting agent.

According to other embodiments of the invention a suitable finish may further include a combined sewing/abrasion polymeric aid, an alkoxylated fatty amine or derivative thereof, a melamine formaldehyde resin or N-methylol stearamide, a flame retardant additive or combinations thereof.

Examples of suitable polymeric cross-linking abrasion resistance aids include, but are not limited to, urethane-based polymers, such as Eccorez FRU-33 (a hydrophobic urethane polymer available from Eastern Color and Chemical); abrasion resistant polymer/perfluoroalkyl containing polymer blends such as Hipel 340 (a proprietary blend of abrasion aid polymers and a perfluoroalkyl containing polymer available from Hi-Tech Chemicals) and Ridgepel 34 (a blended urethane/perfluoroalkyl product available from Blue Ridge Products); and acrylic polymers such as FDP-61063 (a self cross-linking acrylic co-polymer with a Tg of +25° C., available from Omnova Solutions) and Dicrylan TA-GP (a self cross-linking ethylacrylate polymer with a Tg of −14° C., available from Huntsman Chemical). Suitable perfluoroalkyl containing polymers include, but are not limited to, UNIDYNE® TG 580 (a non-ionic C8 perfluoroalkyl polymer available from Daikin America), UNIDYNE® TG 581 (a cationic fluoropolymer available from Daikin America), Rainoff F-8 (a perfluoroalkyl polymer available from Eastern Color and Chemical), and the above mentioned blends of alkylfluoropolymers and abrasion aid polymers, Hipel 340 and Ridgepel 34. Suitable polyethylenes include, but are not limited to, medium and high density polyethylenes. Suitable wetting agents include, but are not limited to, Ridgewet NRW (previously called Genwet NRW and available from Blue Ridge Products). Suitable sewing/abrasion polymeric aids include, but are not limited to, medium to high density polyethylene emulsions such as Aquasoft 706 (available from Apollo Chemicals, Ware Shoals, S.C.). Suitable alkoxylated fatty amines or derivatives thereof include, but are not limited to, Cartafix U (an alkoxylated fatty amine derivative product designed to inhibit finish migration and minimize pad roll build up, available from Clariant). Suitable melamine formaldehyde resins include, but are not limited to, Aerotex M3 (manufactured by Cytec Industries and available from Emerald Carolina Chemicals, Charlotte, N.C.) and Eccoresin M300 (available from Eastern Color and Chemical). Suitable N-methylol stearamides include, but are not limited to, Aurapel 330 (available from Star Chemicals). Suitable flame retardant additives include, but are not limited to, Amgard CT (a cyclic phosphate flame retardant additive, available from Rhodia).

In another embodiment of the present invention, a finishing process can be used to apply a finish to fibers, yarns, fabrics, or garments. In a preferred embodiment the finishing process is used to apply a finish to a protective fabric. The following process is described by way of example, and other process embodiments in accordance with the invention can have fewer or greater numbers of steps, and may be practiced in alternative sequences. A protective fabric comprising a plurality of flame resistant fibers is received for treatment. At this point the protective fabric may be substantially untreated or may be treated with a flame resistant, water resistant, or other composition, but is referred to here as "untreated" to distinguish it from the fabric as treated according to a method of the present invention. A finish composition as described above and consistent with the present invention is applied to the untreated protective fabric. The finish is cured by controlling at least one of the following: heat, pressure, or time. The fabric treated by this process has improved resistance to surface abrasion and/or pilling.

Alternatively, a finish composition according to the present invention can impart abrasion and/or pilling resistance to a fabric when that finish composition is added to another finish composition that is applied to the fabric. For example, a finish composition according to the present invention and comprising a polymeric abrasion aid, fatty amine or derivative thereof, a polyethylene, and optionally one or more of a sewing/abrasion polymeric aid, a crosslinking melamine formaldehyde resin, and a N-methylol stearamide could be added to a known finish composition such as, but not limited to, a moisture management finish, a durable press finish, or an antimicrobial finish. The combination of finishes would then impart a variety of advantageous properties, depending on the finishes used, including abrasion and/or pilling resistance.

In one embodiment, the untreated protective fabric is formed of a plurality of flame resistant fibers, such as the aramid, polybenzimidazole (PBI), polybenzoxazole (PBO), melamine, or other fibers described above.

A variety of methodologies and associated devices can be used to apply the finish to the untreated protective fabric. These methodologies include, but are not limited to, spray application, padding, roll coating, applying a foam finish, and combinations thereof.

In some embodiments, the finish can be cured by applying heat and/or pressure over time to the untreated protective fabric, the finish, or both, until one or more components of the finish are affected. In such instances curing may activate a particular finish component, create cross-linking with the fabric, or otherwise substantially adhere the finish to the untreated protective fabric, while removing any excess moisture that may exist in the untreated protective fabric and/or finish. By way of example but not limitation, a suitable curing process can be an oven drying process to apply heat to the initially treated fabric and finish for approximately 1 to 5 minutes at between about 300 and about 400° F.

EXAMPLES

The present invention is further illustrated by the following examples which illustrate specific embodiments of the invention but are not meant to limit the invention.

Fabrics and Finishes

Examples of various fabrics that have been treated with finish compositions consistent with the present invention are described in Table 1. The fabrics are all woven protective fabrics comprising ring-spun yarns. Fabrics 1-3 are fire service outershell fabrics, fabrics 4 and 5 are fire service outershell fabrics that contain PBO, and fabric 6 is a military protective fabric.

TABLE I

EXAMPLE FABRICS FOR USE WITH THE PRESENT INVENTION

| Fabric | Yarn | Weave | Finished weight |
|---|---|---|---|
| 1 | 60% KEVLAR T-970<br>40% PBI | Rip Stop | 7.7 osy |
| 2 | 60% KEVLAR T-970<br>40% NOMEX T-462 | Rip Stop | 7.5 osy |
| 3 | 60% KEVLAR T-970<br>40% PBI | Plain w/single rip | 7.7 osy |

TABLE I-continued

| EXAMPLE FABRICS FOR USE WITH THE PRESENT INVENTION | | | |
|---|---|---|---|
| Fabric | Yarn | Weave | Finished weight |
| 4 | 60% KEVLAR<br>20% NOMEX T-462<br>20% ZYLON | 2 End Rip Stop | 7.5 osy |
| 5 | 60% TECHNORA<br>40% ZYLON | Rip Stop | 7.5 osy |

TABLE I-continued

| EXAMPLE FABRICS FOR USE WITH THE PRESENT INVENTION | | | |
|---|---|---|---|
| Fabric | Yarn | Weave | Finished weight |
| 6 | 65% FR Rayon<br>25% TWARON<br>10% Nylon | Rip Stop | 6.2 osy |

Various finish compositions consistent with the present invention are described in Table II. These finish compositions include various combinations of (a) Ridgewet NRW (previously called Genwet NRW), a non-rewetting surfactant for improved fabric penetration; (b) Hipel 340, a proprietary blend of abrasion aid polymers and a perfluoroalkyl containing polymer; (c) FDP-61063, a self cross-linking acrylic co-polymer; (d) Dicrylan TA-GP, a self cross-linking ethyl acrylate polymer; (e) Unidyne TG580, a non-ionic fluoropolymer, (f) Unidyne TG581, a cationic fluoropolymer; (g) Cartafix U, an alkoxylated fatty amine derivative; (h) Aerotex M3 or Eccoresin M300, both melamine formaldehyde cross-linking resins; (i) Diammonium Phosphate, a catalyst to promote self-crosslinking of melamine formaldehyde resin; (j) Aquasoft 706, a polyethylene emulsion emulsified with DA6; (k) Aurapel 330R, an N-methylol stearamide reactive hydrophobe; and (l) AmgardCT, a cyclic phosphonate flame retardant additive. All amounts are listed as percent on weight of bath (owb).

Table II also includes a known finish composition, SST. This composition includes Ridgewet NRW, Eccoresin M300, diammonium phosphate, (m) Zonyl 7040 and (n) Zonyl FMX (fluoropolymers available from Huntsman and manufactured by DuPont), and (o) Phobotex JVA (an emulsion of paraffin wax, available from Huntsman).

TABLE II

| EXAMPLE FINISH COMPOSITIONS | | | | | | | | |
|---|---|---|---|---|---|---|---|---|
| | | I | II | III | IV | V | VI | SST |
| (a) Ridgewet NRW | wetting agent | 0.5 | 0.5 | 0.5 | 0.5 | 0.25 | 0.15 | 0.25 |
| (b) Hipel 340 | proprietary abrasion aid polymer/perfluoroalkyl polymer blend | 31.25 | 40.0 | 20-30 | 40.0 | | | |
| (c) FDP-61063 | acrylic polymer | | | | | 12.0 | | |
| (d) Dicrylan TAGP | acrylic polymer | | | | | | 15.0 | |
| (e) Unidyne TG580 | perfluoroalkyl polymer | | | | | 28.0 | | |
| (f) Unidyne TG581 | perfluoroalkyl polymer | | | | | | 28.0 | |
| (g) Cartafix U | alkoxylated fatty amine derivative | | | | 0.1 | | | |
| (h) Aerotex M3/Eccoresin M300 | melamine formaldehyde resin | 2 | 3 | | | | | 1.96 |
| (i) Diammonium Phosphate | crosslinking agent | 0.04 | 0.06 | | | | | 0.0446 |
| (j) Aquasoft 706 | polyethylene emulsion | 2 | 4 | 4 | 4.0 | 5.0 | 5.0 | |
| (k) Aurapel 330R | N-methylol stearamide | | | 5-8 | | | | |
| (l) AmgardCT | flame retardant | | | | | 0.5 | 0.75 | |
| (m) Zonyl 7040 | perfluoroalkyl polymer | | | | | | | 10 |
| (n) Zonyl FMX | perfluoroalkyl polymer blend | | | | | | | 20 |
| (o) Phobotex JVA | paraffin wax/melamine resin | | | | | | | 10 |

* all numbers are percent on weight of bath with the remainder of the compositions water.

Finish compositions were used to treat Fabrics 1-5. Finish I was used to treat Fabrics 1, 2, and 3. Finish II was used to treat Fabrics 4 and 5. And Finish III was used to treat Fabric 6. In each example the finish was applied in a dip finish pad. The finish was then dried and cured. Fabrics 1-5 were dried and cured at 300-400° F. for 1-5 minutes. Fabric 6 was dried and cured at 280-350° F. for 1-5 minutes. The treated fabrics have improved abrasion and pilling resistance over untreated fabrics. The improved abrasion and pilling resistance is retained for at least 5-10 launderings. The treated fabrics retained the water repellent properties and flame resistant properties of untreated fabric and showed dramatically improved resistance to abrasion and pilling over fabrics treated with prior art finishes as measured by standard ASTM test methods such as Random Tumble Pilling and Taber Abrasion. In the examples and data that follow, the fabrics have compositions shown in Table I and were treated with finish compositions as shown in Table II or were treated with the prior art finish SST.

Test Methods

Abrasion resistance was measured in accordance with ASTM D3884 (2007), Standard Test Method for Abrasion Resistance of Textile Fabrics (Rotary Platform Double-Head Method), the disclosure of which is hereby incorporated by reference, using H-18 wheels and a 500 g load on each wheel.

Pilling resistance was measured in accordance with ASTM D3512-05 (Reapproved 2007), Standard Test Method for Pilling Resistance and Other Related Surface Changes of Textile Fabrics: Random Tumble Pilling Tester Method, the disclosure of which is hereby incorporated by reference.

Tensile strength was measured in accordance with ASTM D5034 Standard Test Method for Breaking Strength and Elongation of Textile Fabrics (Grab Test), the disclosure of which is hereby incorporated by reference.

Tear strength was measured in accordance with ASTM D5733 Standard Test Method for Tearing Strength of Nonwoven Fabrics by the Trapezoid Procedure, the disclosure of which is hereby incorporated by reference.

Vertical flammability was measured in accordance with ASTM D6413 Standard Test Method for Flame Resistance of Textiles (Vertical Test), the disclosure of which is hereby incorporated by reference.

Water spray rating was measured in accordance with AATCC Test Method 22 (2005) (AATCC Technical Manual) Water Repellency: Spray Test, the disclosure of which is hereby incorporated by reference.

Water absorption resistance was measured in accordance with NFPA 1971 (2007) Protective Ensembles for Structural Fire Fighting and Proximity Fire Fighting, 8.26 Water Absorption Resistance Test, the disclosure of which is hereby incorporated by reference.

Air permeability was measured in accordance with Federal Test Method 5450.1 Permeability to Air; Cloth, Calibrated Orifice Method, the disclosure of which is hereby incorporated by reference.

The fabric samples were tested either before they were washed (BW), after 5 launderings (5×), or after 10 launderings (10×). All launderings were in accordance with AATCC Test Method 135 2006), Dimensional Changes of Fabrics after Home Laundering. Specifically, specimens are subjected to washing and drying in accordance with Machine Cycle 1: normal/cotton sturdy cycle; Washing Temperature V: 60±3° C. (140±5° F.); Washing Machine Conditions: Normal cycle with water level of 18±1 gal, agitator speed of 179±2 spm, washing time of 12 min, spin speed of 645±15 rpm and final spin time of 6 min; and Dryer Setting Conditions: cotton/sturdy cycle with high exhaust temperature (66±5° C., 150±10° F.) and a cool down time of 10 min.

The standards for flame resistance that are referred to herein are NFPA 1951 2007), Standard on Protective Ensembles for Technical Rescue Incidents; NFPA 1971 (2007), Standard on Protective Ensembles for Structural Fire Fighting and Proximity Fire Fighting; NFPA 1977 (2005), Standard on Protective Clothing and Equipment for Wildlands Fire Fighting; NFPA 2112 (2007), Standard on Flame-Resistant Garments for Protection of Industrial Personnel Against Flash Fire; NFPA 70E Standard for Electrical Safety Requirements for Employee Workplaces; and military specifications MIL-C-83429B and GL-PD-07-12, the disclosures of which are hereby incorporated by reference.

EXPERIMENTAL

Samples of Fabric 2 in Table I were treated with fabric finishes according to embodiments of the present invention (specifically finish compositions II and IV-VI from Table II) or the prior art finish, SST. Each fabric sample was subjected to a standard Taber abrasion test in accordance with ASTM D3884, using H-18 wheels and a 500 g load on each wheel. According to this method a specimen is abraded using rotary rubbing action under controlled conditions of pressure and abrasive action. The test specimen, mounted on a platform, turns on a vertical axis against the sliding rotation of two abrading wheels. One abrading wheel rubs the specimen outward toward the periphery and the other inward toward the center. The resulting abrasion marks form a pattern of crossed arcs over an area of approximately 30 $cm^2$.

Each fabric sample was subjected to 250 cycles and then was inspected for thread break. If no thread break was observed the fabric sample was subjected to 250 additional cycles and was inspected again. This process continued for each fabric sample until a thread break was observed for that sample. The results of the abrasion resistance tests are shown in Table III, below. The fabric samples treated with embodiments of the present invention withstood more cycles before breaking than the fabric samples treated with the prior art finish composition. These data show an improvement in abrasion resistance of at least about 100% over the fabric samples treated with the prior art composition.

TABLE III

ABRASION RESISTANCE

| | | | Taber cycles to first break (10× samples) | | | |
|---|---|---|---|---|---|---|
| | Fabric | Finish | Sample 1 | Sample 2 | Sample 3 | Average |
| A | 2 | SST | 500 | 500 | 500 | 500 |
| B | 2 | II | 1250 | 1000 | 1250 | 1167 |
| C | 2 | IV | 1750 | 2000 | 1600 | 1783 |
| D | 2 | V | 2500 | 2000 | 1500 | 2000 |
| E | 2 | VI | 2000 | 1000 | 1750 | 1583 |

* samples run in increments of 250 cycles and inspected for yarn break

Samples of Fabric 4 in Table I were treated with fabric finishes according to embodiments of the present invention (specifically finish compositions II and IV-VI from Table II) or the prior art finish, SST, and were subjected to tests to determine resistance to pilling. Each fabric sample was subjected to a standard pilling resistance test in accordance with ASTM D3512. According to test method D3512 a specimen is conditioned in an environment chamber and then tumbled in cork lined cylinders with cotton sliver. Bias cut replicates are tested for predetermined times. Samples are evaluated using the photographic rating standards in the Macbeth Light Booth (daylight conditions). A rating of 1 indicates very severe pilling while a rating of 5 represents no pilling. The samples were tested for 60, 90, and 120 minutes. The results of these tests are shown in Table IV, below. The fabrics treated with embodiments of the present invention showed improved resistance to pilling over fabrics treated with the prior art SST finish composition.

TABLE IV

PILLING RESISTANCE

| | Fabric | Finish | 60 min | 90 min | 120 min |
|---|---|---|---|---|---|
| D | 4 | SST | 1 | 1 | 1 |
| G | 4 | II | 4 | 3 | 2-3 |
| H | 4 | IV | 4 | 3-4 | 3 |
| I | 4 | V | 2 | 2 | 2 |
| J | 4 | VI | 4 | 3-4 | 3 |

Samples of Fabrics 2 and 4 in Table I were treated with fabric finishes according to embodiments of the present invention (specifically finish compositions II and IV-VI from Table II) or the prior art finish, SST, and were subjected to a variety of tests to determine tensile strength, tear strength, flame resistance, water repellency, and air permeability.

Tensile strength is the force required to break a fabric under a load. The fabric samples were subjected to a standard tensile test in accordance with ASTM D5034. According to this method a specimen is mounted centrally in clamps of a tensile machine and a force is applied until the specimen breaks. Values for the breaking force and the elongation of the test specimen are obtained from machine scales, dials, autographic recording charts, or a computer interfaced with the testing machine. The tensile strength of each fabric was tested in the warp direction (w) and in the fill direction (f). The results of these tests are shown in Table V below. Based on these results, the finish composition according to the present invention has no adverse impact on the tensile strength of the fabrics.

TABLE V

| TENSILE STRENGTH | | | | | |
|---|---|---|---|---|---|
| | Fabric | Finish | BW (lbs/in) (w × f) | 5× (lbs/in) (w × f) | 10× (lbs/in) (w × f) |
| A | 2 | SST | 307.4 × 294.7 | 271.8 × 223.2 | 272.7 × 223.8 |
| B | 2 | II | 341.0 × 315.0 | 317.0 × 265.9 | 304.8 × 250.0 |
| C | 2 | IV | 336.1 × 290.0 | 310.4 × 280.7 | 326.5 × 269.7 |
| D | 2 | V | 316.9 × 299.3 | 308.1 × 259.8 | 295.5 × 247.0 |
| E | 2 | VI | 325.7 × 284.6 | 334.9 × 267.4 | 322.1 × 283.7 |
| F | 4 | SST | 452.7 × 401.5 | 411.3 × 384.8 | 400.0 × 358.4 |
| G | 4 | II | 489.4 × 420.7 | 465.5 × 446.0 | 427.1 × 400.0 |
| H | 4 | IV | 471.2 × 395.3 | 467.2 × 417.1 | 417.6 × 424.0 |
| I | 4 | V | 452.5 × 411.8 | 448.0 × 403.0 | 392.8 × 389.6 |
| J | 4 | VI | 449.5 × 399.4 | 452.6 × 421.7 | 405.7 × 398.0 |

Tear strength is the force required either to start or to continue or propagate a tear in a fabric. Each fabric sample was also subjected to a standard tear strength test in accordance with ASTM D5733. According to this method an outline of an isosceles trapezoid is marked on a rectangular specimen cut for the determination of tearing strength. The specimen is slit at the center of the smallest base of the trapezoid to start the tear. The nonparallel sides of the trapezoid marked on the specimen are clamped in parallel jaws of a tensile testing machine. The separation of the jaws is continuously increased to apply a force to propagate the tear across the specimen. At the same time, the force developed is recorded. The maximum force to continue the tear is calculated from autographic chart recorders, or microprocessor data collection systems. Tear strength of each fabric was determined in the warp direction (w) and in the fill direction (f). The results of these tests are shown in Table VI below. Based on these results, the finish composition according to the present invention has no adverse impact on the tear strength of the fabric.

TABLE VI

| TEAR STRENGTH | | | | | |
|---|---|---|---|---|---|
| | Fabric | Finish | BW (lbs/in) (w × f) | 5× (lbs/in) (w × f) | 10× (lbs/in) (w × f) |
| A | 2 | SST | 52.1 × 40.4 | 40.1 × 33.2 | 36.9 × 36.3 |
| B | 2 | II | 52.5 × 36.5 | 46.1 × 35.3 | 42.4 × 32.8 |

TABLE VI-continued

| TEAR STRENGTH | | | | | |
|---|---|---|---|---|---|
| | Fabric | Finish | BW (lbs/in) (w × f) | 5× (lbs/in) (w × f) | 10× (lbs/in) (w × f) |
| C | 2 | IV | 49.8 × 37.4 | 47.7 × 37.5 | 44.7 × 34.2 |
| D | 2 | V | 46.4 × 33.3 | 44.0 × 32.7 | 40.5 × 30.5 |
| E | 2 | VI | 46.3 × 34.8 | 46.0 × 36.6 | 44.0 × 35.7 |
| F | 4 | SST | 52.5 × 50.1 | 48.8 × 44.2 | 44.1 × 39.7 |
| G | 4 | II | 57.1 × 47.2 | 55.2 × 47.3 | 50.4 × 49.0 |
| H | 4 | IV | 55.5 × 51.7 | 56.1 × 50.9 | 52.2 × 49.0 |
| I | 4 | V | 56.0 × 44.5 | 53.4 × 42.4 | 50.0 × 37.8 |
| J | 4 | VI | 54.6 × 44.8 | 53.4 × 46.0 | 47.3 × 40.7 |

The flame resistant properties of the fabrics were tested according to ASTM D6413. According to this method a fabric is hung vertically and exposed to an open flame. The char length and afterflame are determined for each fabric. The char length for each fabric was determined in the warp direction (w) and in the fill direction (f). The results of this test for the fabrics described herein are shown in Table VII below. Based on these results, the finish composition according to the present invention has no adverse impact on the flame resistant properties of the fabric.

TABLE VII

| VERTICAL FLAMMABILITY | | | | | | |
|---|---|---|---|---|---|---|
| | | | Char Length (in) w × f | | After Flame (sec) w × f | |
| Sample | Fabric | Finish | BW | 5× | BW | 5× |
| A | 2 | SST | 0.6 × 0.5 | 0.5 × 0.4 | 0.0 | 0.0 |
| B | 2 | II | 0.7 × 0.6 | 0.4 × 0.4 | 0.0 | 0.0 |
| C | 2 | IV | 0.8 × 0.6 | 0.6 × 0.5 | 0.0 | 0.0 |
| D | 2 | V | 0.8 × 0.6 | 0.5 × 0.4 | 0.0 | 0.0 |
| E | 2 | VI | 0.8 × 0.6 | 0.6 × 0.5 | 0.0 | 0.0 |
| F | 4 | SST | 0.1 × 0.1 | 0.1 × 0.1 | 0.0 | 0.0 |
| G | 4 | II | 0.1 × 0.1 | 0.1 × 0.1 | 0.0 | 0.0 |
| H | 4 | IV | 0.1 × 0.1 | 0.1 × 0.1 | 0.0 | 0.0 |
| I | 4 | V | 0.1 × 0.0 | 0.1 × 0.0 | 0.0 | 0.0 |
| J | 4 | VI | 0.1 × 0.1 | 0.1 × 0.1 | 0.0 | 0.0 |

The water resistance of the fabrics was determined using AATCC test method 22 and NFPA 1971, 8.26. According to AATCC test method 22, water is sprayed against a taut surface of a test specimen under controlled conditions and produces a wetted pattern whose size depends on the repellency of the fabric. Evaluation is accomplished by comparing the wetted pattern with pictures on a standard chart. According to NFPA 1971, 8.26, a specimen is mounted to an embroidery hoop and a volume of water is allowed to spray onto the specimen. Blotting paper is used to remove excess water and a 4 in×4 in square is cut from the sample. The wet sample is weighed, dried, and weighed again. The percent water absorption (PWA) is determined based on the difference in the wet and dry weights. The results for both of these tests are shown in Table VIII below. Based on these results the finish compositions of the present invention do not affect the water repellent properties of the fabric and these fabrics pass the requirements of water resistance of NFPA 1971.

The permeability to air of the fabrics was determined using Federal Test Method 5450.1. According to this method, a specimen is clamped into position across a cloth orifice at a slight tension and in a smooth condition. Air is drawn through the cloth and through the calibrated orifice by means of a suction fan. The pressure drop across the cloth is adjusted to the required pressure drop by adjusting the speed of the fan motor. The volume of air passing through the cloth is calculated from this value and the calibration of the orifice. The results of this test are shown in Table VIII below. Based on these results the finish compositions of the present invention do not affect the air permeability properties of the fabrics and that these fabrics pass the requirements of air permeability of NFPA 1971.

TABLE VIII

WATER SPRAY/ABSORPTION AND AIR PERMEABILITY

| | | | Water Spray (rating) | | Water Absorption (%) | | Air Permeability |
|---|---|---|---|---|---|---|---|
| Sample | Fabric | Finish | BW | 5× | BW | 5× | ($ft^3/min/ft^2$) |
| A | 2 | SST | 100 | 70 | .04 | 0 | 19.6 |
| B | 2 | II | 100 | 70 | .04 | 1.3 | 19.1 |
| C | 2 | IV | 100 | 80 | 0.7 | 0 | 17.5 |
| D | 2 | V | 100 | 90 | 0.3 | 2.0 | 18.6 |
| E | 2 | VI | 100 | 90 | 0.7 | 1.0 | 18.3 |
| F | 4 | SST | 100 | 80 | 0.3 | 2.0 | 6.4 |
| G | 4 | II | 100 | 100 | 1 | 1.3 | 19.2 |
| H | 4 | IV | 100 | 100 | 1 | 1 | 18.5 |
| I | 4 | V | 100 | 95 | 0.7 | 1.6 | 18.6 |
| J | 4 | VI | 100 | 95 | 0.5 | 1.0 | 22.8 |

The samples depicted in FIGS. 2-7 were subjected to the ASTM D3884 test for abrasion resistance using H-18 wheels and a 500 g load on each wheel, which was described previously.

Figure 2:
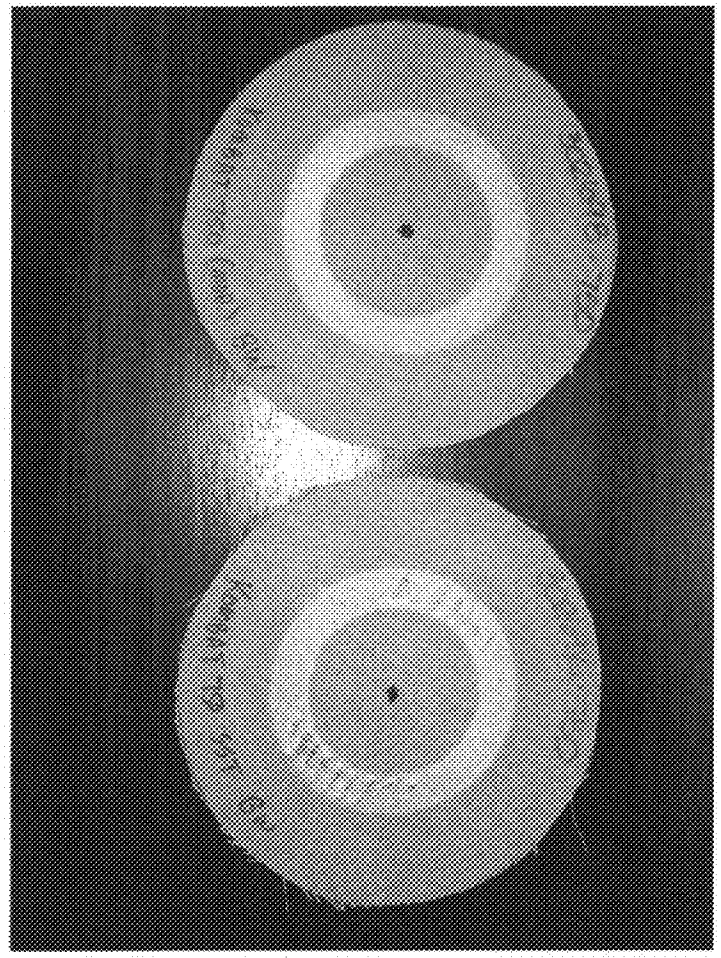
FIG. 2 illustrates the improved abrasion resistance of a 60/40 para-aramid/PBI fabric treated with a finish composition consistent with the present invention as compared to a sample of the same fabric treated with a known finish composition.

FIG. 2 depicts two samples of Fabric 1 from Table 1. The fabric sample on the left was treated with finish composition I as described in Table II. The fabric sample on the right was treated with the SST finish composition described in Table II. The abrasion resistance of both fabric samples was tested in accordance with the ASTM standard described above. The fabric samples were not laundered prior to testing. The fabric sample treated according to an embodiment of the present invention shows improved abrasion resistance over the fabric sample treated with the known finish composition.

Figure 3:
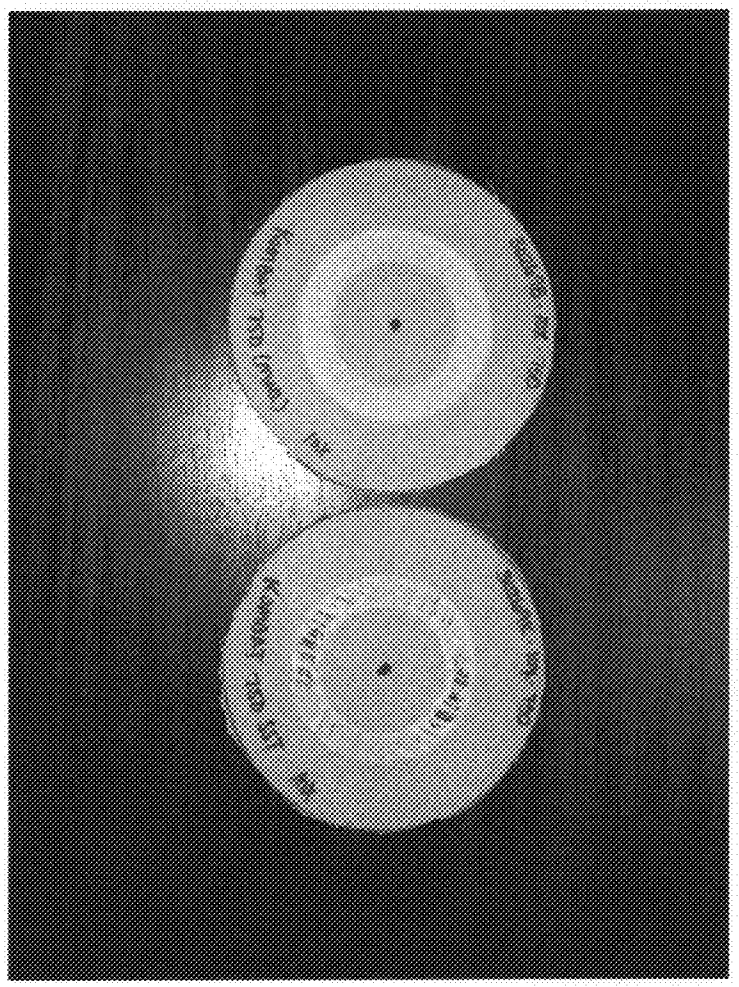
FIG. 3 illustrates the improved abrasion resistance of a 60/40 para-aramid/PBI fabric treated with a finish composition consistent with the present invention as compared to a sample of the same fabric treated with a known finish composition.

FIG. 3 depicts two samples of Fabric 1 from Table 1. The fabric sample on the left was treated with finish composition I as described in Table II. The fabric sample on the right was treated with the SST finish composition. The abrasion resistance of both fabrics was tested in accordance with the ASTM standard described above. The fabric samples were laundered 10 times prior to testing. The fabric sample treated according to an embodiment of the present invention shows improved abrasion resistance over the fabric sample treated with the known finish composition.

Figure 4:
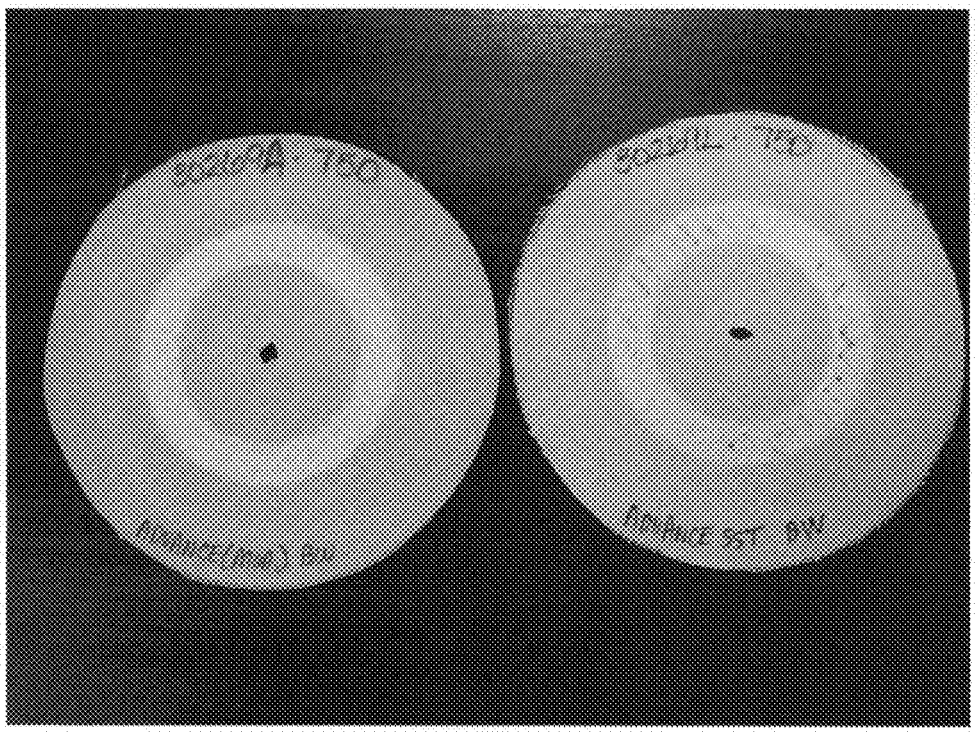
FIG. 4 illustrates the improved abrasion resistance of a 60/40 para-aramid/meta-aramid fabric treated with a finish composition consistent with the present invention as compared to a sample of the same fabric treated with a known finish composition.

FIG. 4 depicts two samples of Fabric 2 from Table 1. The fabric sample on the left was treated with finish composition I as described in Table II. The fabric sample on the right was treated with the SST finish composition. The abrasion resistance of both fabric samples was tested in accordance with the ASTM standard described above. The fabric samples were not laundered prior to testing. The fabric sample treated according to an embodiment of the present invention shows improved abrasion resistance over the fabric sample treated with the known finish composition.

Figure 5:
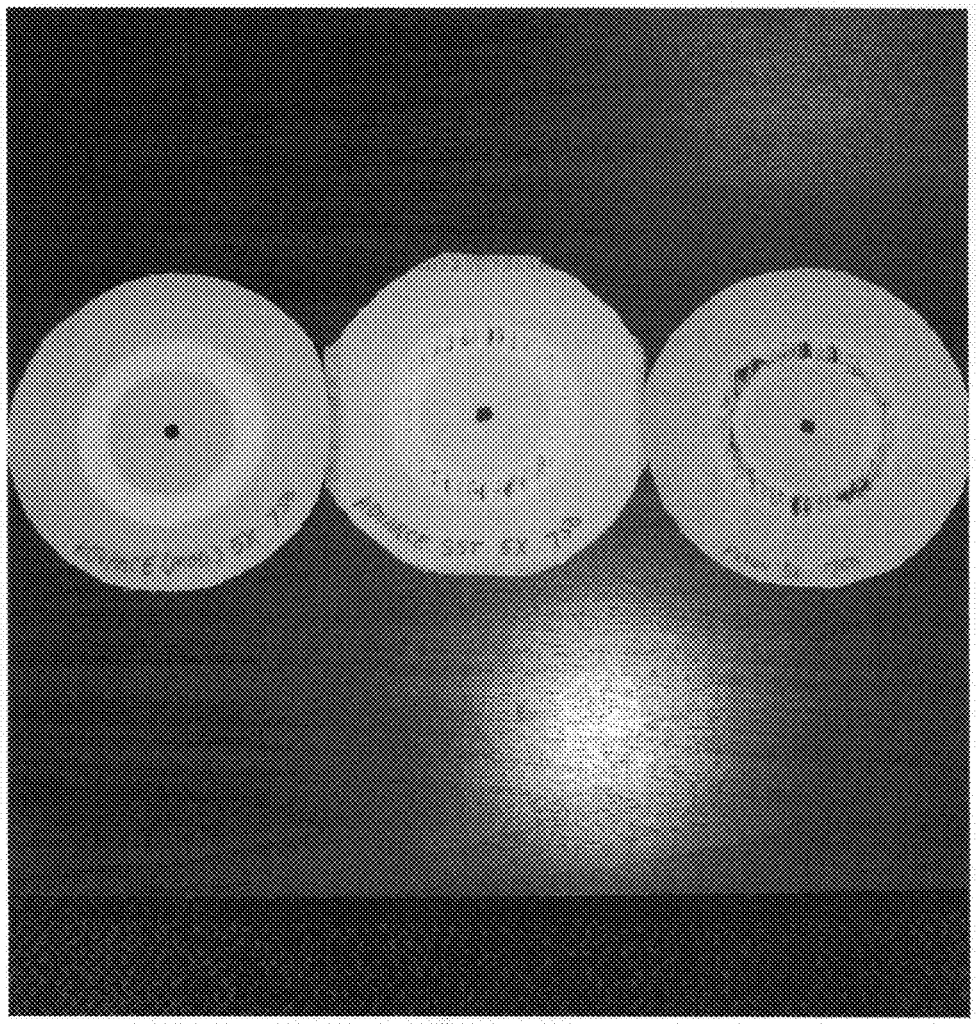
FIG. 5 illustrates the improved abrasion resistance of a 60/40 para-aramid/meta-aramid fabric treated with a finish composition consistent with the present invention as compared to a sample of the same fabric treated with a known finish composition and as compared to a sample of a similar fabric that is commercially available.

FIG. 5 depicts two samples of Fabric 2 from Table I and one sample of Fusion fabric available from Safety Components. The fabric samples on the left and in the middle are Fabric 2 from Table I and the fabric sample on the right is Fusion. Fusion is a 50/50 p-aramid/m-aramid blend fabric. The sample of Fabric 2 on the far left was treated with finish composition I as described in Table II. The sample of Fabric 2 shown in the middle was treated with the SST finish composition. The abrasion resistance of the three fabric samples was tested in accordance with the ASTM standard described above. The fabric samples were laundered 5 times prior to testing. The fabric sample on the far left, which was treated according to an embodiment of the present invention, shows improved abrasion resistance over the fabric sample treated with the SST finish composition and the Fusion fabric.

Figure 6:
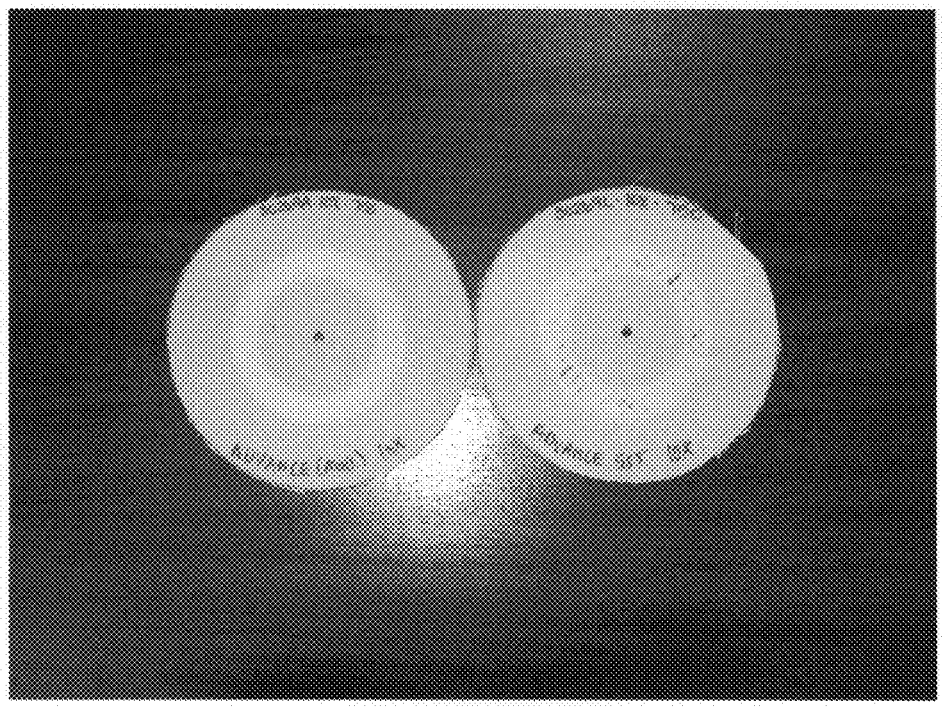
FIG. 6 illustrates the improved abrasion resistance of a 60/40 para-aramid/meta-aramid fabric treated with a finish composition consistent with the present invention as compared to a sample of the same fabric treated with a known finish composition.

FIG. 6 depicts two samples of Fabric 2 from Table I. The fabric sample on the left was treated with finish composition I as described in Table II. The fabric sample on the right was treated with the SST finish composition. The abrasion resistance of both fabric samples was tested in accordance with the ASTM standard described above. The fabric samples were laundered 10 times prior to testing. The fabric sample treated according to an embodiment of the present invention shows improved abrasion resistance over the fabric sample treated with the known finish composition.

Figure 7:
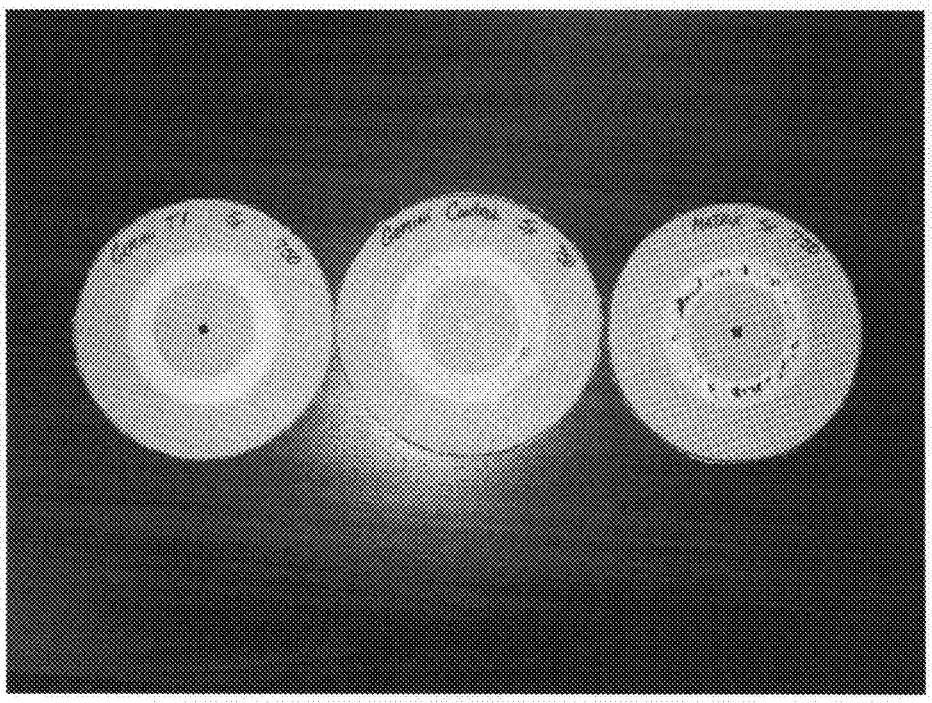
FIG. 7 illustrates the improved abrasion resistance of a 60/40 para-aramid/PBI fabric treated with a finish composition consistent with the present invention as compared to a sample of the same fabric treated with a known finish composition and as compared to a sample of a similar fabric that is commercially available.

FIG. 7 depicts two samples of Fabric 3 from Table I and one sample of Matrix fabric, available from Safety Components. The fabric samples on the left and in the middle are Fabric 3 from Table I and the fabric sample on the right is Matrix. Matrix fabric is a 60/40 p-aramid/PBI fabric. The sample of Fabric 3 on the left was treated with finish composition I as described in Table II. The sample of Fabric 3 in the middle was treated with the SST finish composition. The abrasion resistance of the three fabric samples was tested in accordance with the ASTM standard described above. The fabric samples were laundered 5 times prior to testing. The fabric sample on the left, which was treated according to an embodiment of the present invention, shows improved abrasion resistance over the fabric sample treated with the SST finish composition and the Matrix fabric.

Figure 8:
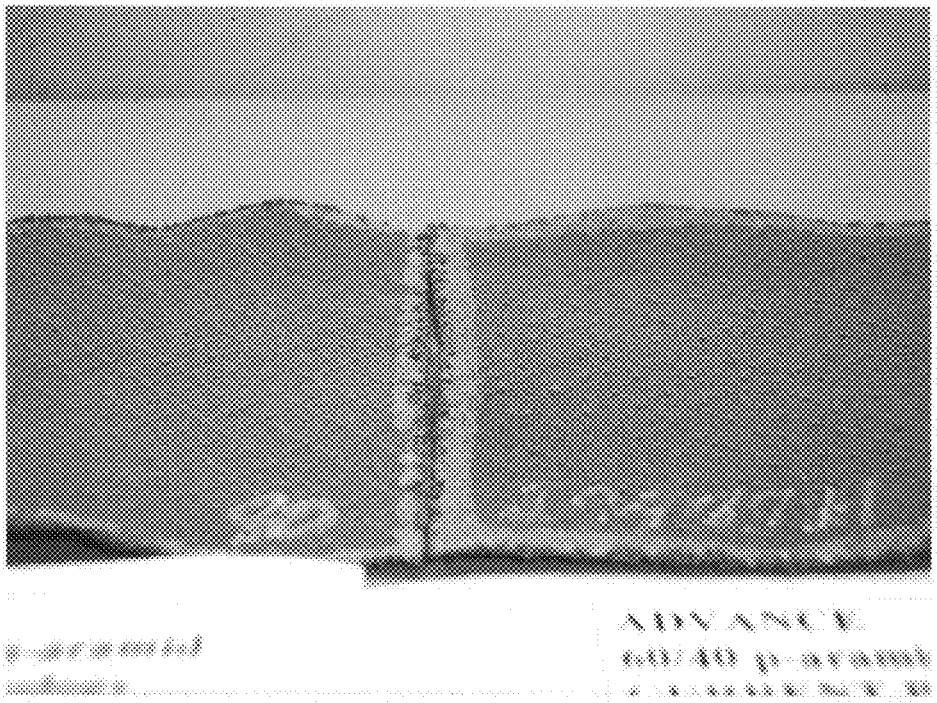
FIG. 8 illustrates the improved pilling resistance of a 60/40 para-aramid/meta-aramid fabric treated with a finish composition consistent with the present invention as compared to a sample of the same fabric treated with a known finish composition.
Figure 9:
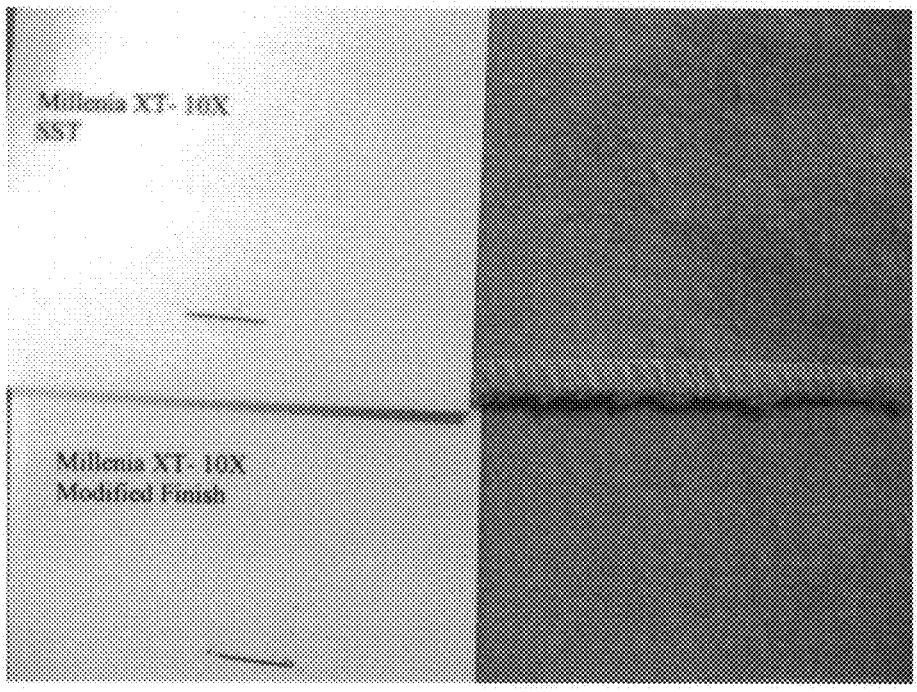
FIG. 9. illustrates the improved pilling resistance of a 60/40 para-aramid/PBO fabric treated with a finish composition consistent with the present invention as compared to a sample of the same fabric treated with a known finish composition.

The samples depicted in FIGS. 8 and 9 were subjected to the ASTM D3512 test for pilling resistance, which was described previously.

FIG. 8 depicts two samples of Fabric 2 from Table I. The fabric sample on the left was treated with finish composition I as described in Table II. The fabric sample on the right was treated with the SST finish composition. The pilling resistance of both fabric samples was tested in accordance with the ASTM standard described above. The fabric samples were not laundered prior to testing. The fabric sample treated according to an embodiment of the present invention shows improved pilling resistance over the fabric sample treated with the known finish composition.

FIG. 9 depicts two samples of Fabric 5 from Table I. The fabric sample on the bottom was treated with finish composition I as described in Table II. The fabric sample on top was treated with the SST finish composition. The pilling resistance of both fabric samples was tested in accordance with the ASTM standard described above. The fabric samples were laundered 10 times prior to testing. The fabric sample treated according to an embodiment of the present invention shows improved pilling resistance over the fabric sample treated with the known finish composition.

The foregoing is provided for purposes of illustrating, explaining, and describing exemplary embodiments and certain benefits of the present invention. Modifications and adaptations to the illustrated and described embodiments will be apparent to those skilled in the art and may be made without departing from the scope or spirit of the invention.

The invention claimed is:

1. A flame resistant fabric comprising:

a plurality of spun yarns comprising a plurality of inherently flame resistant fibers, the plurality of inherently flame resistant fibers comprising at least one of meta-aramid fibers, para-aramid fibers, polybenzimidazole fibers, polybenzoxazole fibers, melamine fibers, polyimide fibers, or polyimideamide fibers; and a finish that imparts abrasion resistance to the fabric, the finish comprising a polymeric abrasion resistance aid and an alkylfluoropolymer, wherein the fabric, before laundering and after being laundered five times in accordance with AATCC test method 135 (2006), has an abrasion resistance of at least about 1000 cycles before a first thread break when tested in accordance with ASTM test method 03884 (2007) (H-18, 500 g on each wheel).

2. The flame resistant fabric of claim 1, wherein the abrasion resistance is at least about 1500 cycles before a first thread break.

3. The flame resistant fabric of claim 2, wherein the abrasion resistance is at least about 2500 cycles before a first thread break.

4. The flame resistant fabric of claim 1, wherein the fabric meets all flammability requirements of one or more of NFPA 1951 (2007), NFPA 1971 (2007), NFPA 1977 (2005), NFPA 2112 (2007), military specification MIL-C-83429B, or military specification GL-PD-07-12.

5. The flame resistant fabric of claim 4, wherein the fabric has been laundered ten times in accordance with AATCC test method 135 (2006).

6. The flame resistant fabric of claim 1, wherein the fabric meets all water repellency requirements of one or both of NFPA 1951 (2007) or NFPA 1971 (2007).

7. The flame resistant fabric of claim 6, wherein the fabric has been laundered ten times in accordance with AATCC test method 135 (2006).

8. The flame resistant fabric of claim 1, wherein the fabric has water repellant properties comprising a water spray rating of about 100 as determined by AATCC test method 22 (2005) and a water absorption of less than or equal to about 1.0% as determined by NFPA 1971, 8.26 (2007).

9. The flame resistant fabric of claim 1, wherein the fabric, before laundering and after being laundered five times in accordance with AATCC test method 135 (2006), has water repellant properties comprising a water spray rating of at least about 70 as determined by AATCC test method 22 (2005) and a water absorption of less than or equal to about 2.0% as determined by NFPA 1971, 8.26 (2007).

10. The flame resistant fabric of claim 1, wherein the fabric has a pilling performance rating of at least 4 after 60 minutes and a rating of at least 3 after 90 minutes when tested in accordance with ASTM test method D3512-05 (Reapproved 2007).

11. The flame resistant fabric of claim 10, wherein the pilling performance rating is at least 4 after 90 minutes and at least 3 after 120 minutes.

12. The flame resistant fabric of claim 1, wherein the fabric has a weight of less than about 8.0 osy.

13. The flame resistant fabric of claim 1, wherein the fabric meets air permeability requirements in accordance with NFPA 1971 (2007).

14. A flame resistant fabric comprising polybenzimidazole fibers, wherein the fabric comprises a finish that imparts abrasion resistance to the fabric, the finish comprising a polymeric abrasion resistance aid and an alkylfluoropolymer, wherein the fabric, before laundering and after being laundered five times in accordance with AATCC test method 135 (2006), has an abrasion resistance of at least about 1000 cycles before a first thread break when tested in accordance with ASTM test method D3884 (2007) (H-18, 500 g on each wheel).

15. The flame resistant fabric of claim 14, wherein the polymeric abrasion resistance aid comprises an acrylic polymer.

16. The flame resistant fabric of claim 14, wherein the abrasion resistance is at least about 1500 cycles before a first thread break.

17. The flame resistant fabric of claim 16, wherein the abrasion resistance is at least about 2500 cycles before a first thread break.

18. The flame resistant fabric of claim 14, wherein the fabric meets all flammability requirements of one or more of NFPA 1951 (2007), NFPA 1971 (2007), NFPA 1977 (2005), NFPA 2112 (2007), military specification MIL-C-83429B, or military specification GL-PD-07-12.

19. The flame resistant fabric of claim 18, wherein the fabric has been laundered ten times in accordance with AATCC test method 135 (2006).

20. The flame resistant fabric of claim 14, wherein the fabric meets all water repellency requirements of one or both of NFPA 1951 (2007) or NFPA 1971 (2007).

21. The flame resistant fabric of claim 20, wherein the fabric has been laundered ten times in accordance with AATCC test method 135 (2006).

22. The flame resistant fabric of claim 14, wherein the fabric has water repellant properties comprising a water spray rating of about 100 as determined by AATCC test method 22 (2005) and a water absorption of less than or equal to about 1.0% as determined by NFPA 1971, 8.26 (2007).

23. The flame resistant fabric of claim 14 wherein the fabric, before laundering and after being laundered five times in accordance with AATCC test method 135 (2006), has water repellant properties comprising a water spray rating of at least about 70 as determined by AATCC test method 22 (2005) and a water absorption of less than or equal to about 2.0% as determined by NFPA 1971, 8.26 (2007).

24. The flame resistant fabric of claim 14, wherein the fabric has a pilling performance rating of at least 4 after 60 minutes and a rating of at least 3 after 90 minutes when tested in accordance with ASTM test method D3512-05 (Reapproved 2007).

25. The flame resistant fabric of claim 24, wherein the pilling performance rating is at least 4 after 90 minutes and at least 3 after 120 minutes.

26. The flame resistant fabric of claim 1, wherein the polymeric abrasion resistance aid is an acrylic polymer.

27. The flame resistant fabric of claim 1, wherein the finish further comprises at least one of an alkoxylated fatty amine or derivative thereof, a melamine formaldehyde resin, an N-methylol stearamide, or combinations thereof.

28. The flame resistant fabric of claim 14, wherein the finish further comprises at least one of an alkoxylated fatty amine or derivative thereof, a melamine formaldehyde resin, an N-methylol stearamide, or combinations thereof.

29. The flame resistant fabric of claim 1, wherein the fabric comprises a plain weave, a rip-stop, a twill weave, sateen weave or knitted fabric and wherein the fabric is stretch or non-stretch.

30. The flame resistant fabric of claim 14, wherein the fabric comprises a plain weave, a rip-stop, a twill weave, sateen weave or knitted fabric and wherein the fabric is stretch or non-stretch.

31. A flame resistant garment comprising the flame resistant fabric of claim 1.

32. A flame resistant garment comprising the flame resistant fabric of claim 14.

33. The flame resistant fabric of claim 30, wherein the fabric has a weight of less than about 8.0 osy.

* * * * *